US008967834B2

(12) United States Patent
Timmerman et al.

(10) Patent No.: US 8,967,834 B2
(45) Date of Patent: Mar. 3, 2015

(54) CURVED DEAD FRONT DISPLAY

(71) Applicant: Conopco, Inc., Englewood Cliffs, NJ (US)

(72) Inventors: Kenneth Dykes Timmerman, Huntsville, AL (US); Gregory Kent Thompson, Huntsville, AL (US)

(73) Assignee: Iluminage Beauty, Ltd., Yokne'am Illit (IL)

( * ) Notice: Subject to any disclaimer, the term of this patent is extended or adjusted under 35 U.S.C. 154(b) by 45 days.

(21) Appl. No.: 13/851,403

(22) Filed: Mar. 27, 2013

(65) Prior Publication Data

US 2013/0314900 A1 Nov. 28, 2013

Related U.S. Application Data

(60) Provisional application No. 61/650,693, filed on May 23, 2012.

(51) Int. Cl.

| | |
|---|---|
| ***G09F 13/04*** | (2006.01) |
| ***G09F 9/302*** | (2006.01) |
| ***G09F 9/33*** | (2006.01) |
| ***G09F 13/22*** | (2006.01) |

(52) U.S. Cl.

CPC ..... *G09F 13/04* (2013.01); *G09F 9/302* (2013.01); *G09F 9/33* (2013.01); *G09F 13/22* (2013.01); *Y10S 362/806* (2013.01)

USPC ..... 362/311.02; 362/249.02; 362/806

(58) Field of Classification Search

USPC ..... 362/311.02, 249.02

See application file for complete search history.

(56) References Cited

U.S. PATENT DOCUMENTS

| | | | | |
|---|---|---|---|---|
| 1,122,100 | A * | 12/1914 | Gilsey | 40/573 |
| 1,137,070 | A * | 4/1915 | Miller | 40/573 |
| 1,358,367 | A * | 11/1920 | Ette | 40/573 |
| 2,597,584 | A * | 5/1952 | Hopkins | 340/470 |
| 6,443,590 | B1 * | 9/2002 | Lovitt | 362/103 |
| 8,567,961 | B2 * | 10/2013 | Huebner | 353/94 |
| 2005/0195614 | A1 | 9/2005 | Bayersdorfer | |
| 2011/0292675 | A1 | 12/2011 | Wang | |
| 2012/0281423 | A1 * | 11/2012 | Wippler | 362/489 |

FOREIGN PATENT DOCUMENTS

| | | |
|---|---|---|
| EP | 1107218 A1 | 6/2001 |
| EP | 1505560 A2 | 2/2005 |

(Continued)

OTHER PUBLICATIONS

Co-pending Application Temmerman et al., et al. U.S. Appl. No. 13/851,417, filed Mar. 27, 2013.

(Continued)

*Primary Examiner* — Laura Tso

(74) *Attorney, Agent, or Firm* — Smith Risley Tempel Santos, LLC; Gregory S. Smith; Patrick D. Lowder

(57) ABSTRACT

A curved dead front display assembly is provided which includes a first plastic layer, a transparent structural plastic layer, a mask layer with light transparent windows defining at least one graphic, a baffle layer having light transmitting hollow chambers, and a printed circuit board featuring light emitting diodes and electrical signal connections. The curved geometry achieves a sharp graphic image by electrically adjusting energy to each of the LEDs.

9 Claims, 3 Drawing Sheets

(56) References Cited

FOREIGN PATENT DOCUMENTS

| | | | |
|---|---|---|---|
| JP | 2010266613 | A2 | 11/2010 |
| WO | WO2009068518 | A1 | 6/1990 |

OTHER PUBLICATIONS

International Search Report in PCT Application PCT/EP2013/060110 mailed Aug. 28, 2013.
Written Opinion in PCT Application PCT/EP2013/060110.

* cited by examiner

CURVED DEAD FRONT DISPLAY

This application claims priority under 35 U.S.C. 119 from U.S. Provisional Application Ser. No. 61/650,693, filed May 23, 2012, and incorporated by reference herein in its entirety.

BACKGROUND OF THE INVENTION

1. Field of the Invention

The invention concerns dead front display assemblies having curvature.

2. The Related Art

Dead front graphics have many benefits. The graphics are visible only when you want them to be. They can conceal a light emitting diode (LED) forming a symbol or printed message on a display window. The message or symbol can be a warning light or a caution light that might go unnoticed if the normal transparent LED were visible at all times. Automobile dashboards are illustrative of this configuration.

Dead front graphics easily blend in with the background. They attract a user's attention and cause them to act only when it is lit. Dead fronting "cleans up" the appearance of a panel and avoids end user confusion during operation.

A problem with the known technology is that dead front displays are created at flat surfaces. There has been technical difficulty in providing curved surfaces that can display a graphic of good uniform quality along the full surface of the geometry.

SUMMARY OF THE INVENTION

A curved dead front display assembly is provided which includes:

- a first plastic layer having outer and inner surfaces;
- a transparent structural plastic layer having a first and second surface, the first surface contacting the inner surface of the first plastic layer;
- a mask layer with an array of light transparent windows defining at least one graphic and having a front and a rear side, the front side contacting the second surface of the structural plastic layer;
- a baffle layer having a plurality of hollow chambers allowing light transmission from an open end to an exit end, the chambers being separated from one another by light opaque walls, the exit end contacting the rear side of the mask layer; and
- a printed circuit board having electrical signal connections and an upper surface including a plurality of light emitting diodes, each of the light emitting diodes being aligned with one of the plurality of chambers, the upper surface contacting the open end of the baffle layer.

BRIEF DESCRIPTION OF THE DRAWINGS

Further advantages and features of the invention still become more apparent from consideration of the following drawings in which.

DETAILED DESCRIPTION OF THE INVENTION

In the past, dead front displays invariably involved and indeed required a limitation to flat surface geometry. Now we have discovered a way to achieve uniformly excellent brightness in a curved architecture. The problem has been solved by electrically balancing light energy output from an array of light emitting diodes in proportion to respective differences in distance from the LED to the curved geometry.

Figure 1:
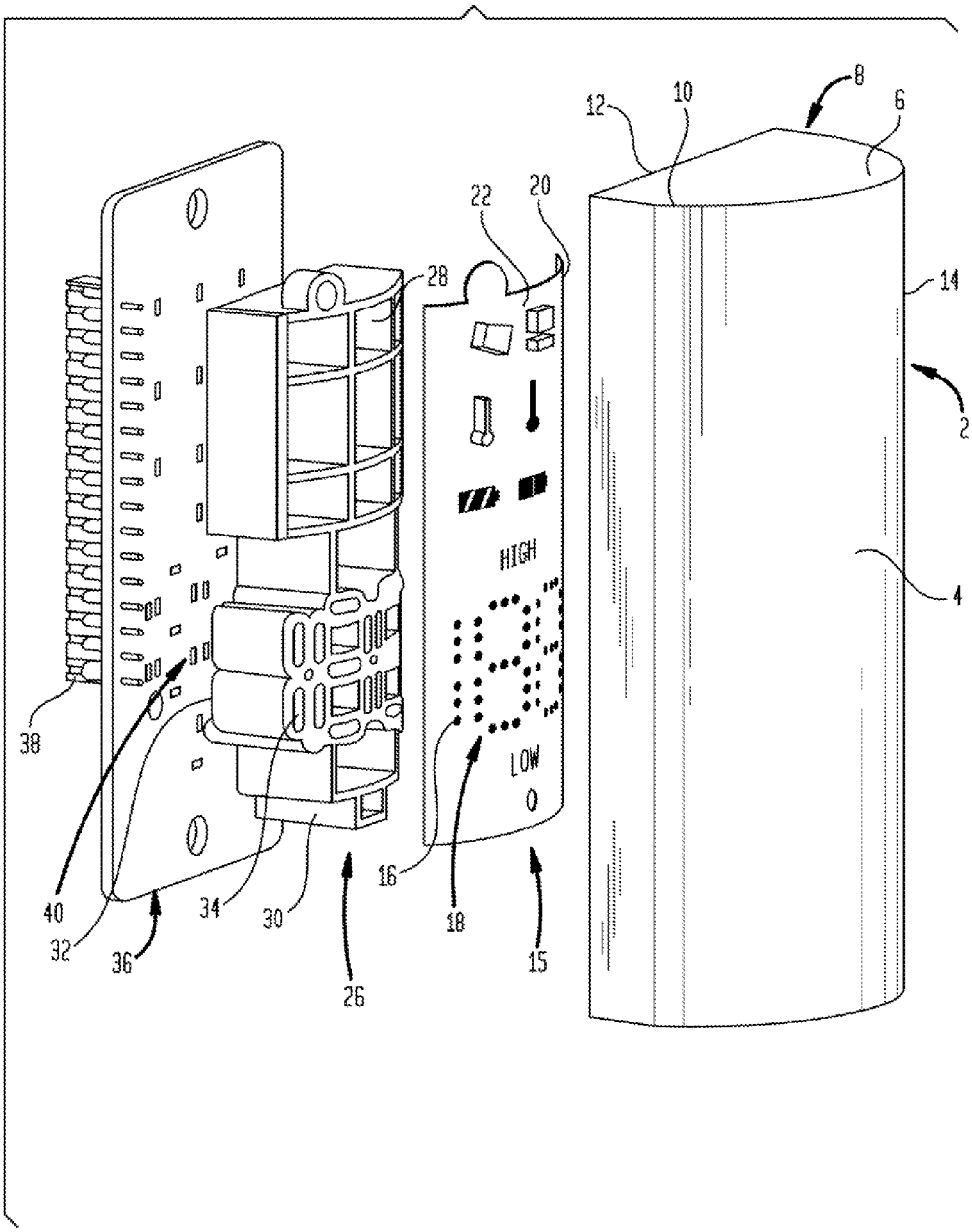
FIG. 1 is an exploded view of a display assembly as described herein.

FIG. 1 illustrates in an exploded view elements of a curved display assembly. Accordingly, the assembly includes a first plastic layer 2 having an outer surface 4 and an inner surface 6. The first plastic layer 2 may be translucent but not transparent when back lighted from the rear; when not back lighted, layer 2 viewed by a human observer from the front will appear opaque because of diffused reflective light from the outer surface 4.

Underneath the first plastic layer is a structural plastic layer 8 having a first surface 10 and a second surface 12. The first surface is in contact with the inner surface of the first plastic layer. The first plastic layer and the structural plastic layer feature curvature in a rounded area 14.

A mask layer 15 features an array of light transparent windows 16 defining at least one graphic 18. A front side 20 and a rear side 22 define the two major surfaces of the mask layer. The front side contacts the second surface of the structural plastic layer.

Graphic 18 may depict a symbol, a numeral, an alphabet letter, a word or combinations thereof. Ordinarily, but not necessarily, the graphic may be composed of pixels which in a grouped arrangement allow a viewer to visualize a symbol, a numeral, an alphabet letter, words and the like. Graphics and their component pixels may be present in any amounts. Their number may range from one to several thousand, sometimes from three to several hundred, other times from four to fifty pixels.

The pixels and their resultant graphics can be formed in a variety of ways on the mask layer. All have in common the formation of a light transparent set of pixel windows. For instance, formation of pixels and thereby the graphic may be achieved by laser etching of a light opaque mask layer. The etching removes pigments or dyes from a transparent film that has been coated with dyed or pigmented paint. Alternatively, the laser may etch pixels in the mask layer by burning apertures directly through the mask layer to create a light transmitting opening. Chemical methods may also be utilized to selectively remove pigments from areas of the mask to create transparent windows that form pixels. Photoresist technology may be utilized for this purpose.

A baffle layer 26 is a further constituent of the display assembly. A plurality of hollow chambers 28 constitute the baffle layer. Light opaque walls 30 form the chambers and separate one from another. Each chamber has an open end 32 and an exit end 34. Light is transmitted through the chamber in a direction from the open end to the exit end. The opaque walls of the chamber prevent light from diffusing to other parts of the baffle layer. When assembled, the exit end contacts the rear side of the mask layer.

Another component of the display assembly is a printed circuit board 36 featuring electrical signal connections 38. A set of light emitting diodes 40 are integrated into the printed circuit board. Each of the LEDs are aligned with one of the chambers of the baffle layer. When assembled, an upper surface 42 of the printed circuit board contacts the open ends of the baffle layer.

Curvature for purposes of this application may mean a concave or a convex geometry. It may also be a combination of these geometries such as in a sinusoidal configuration. Curvature may be regular such as in a rounded shape or can be of an irregular geometry.

Figure 2:
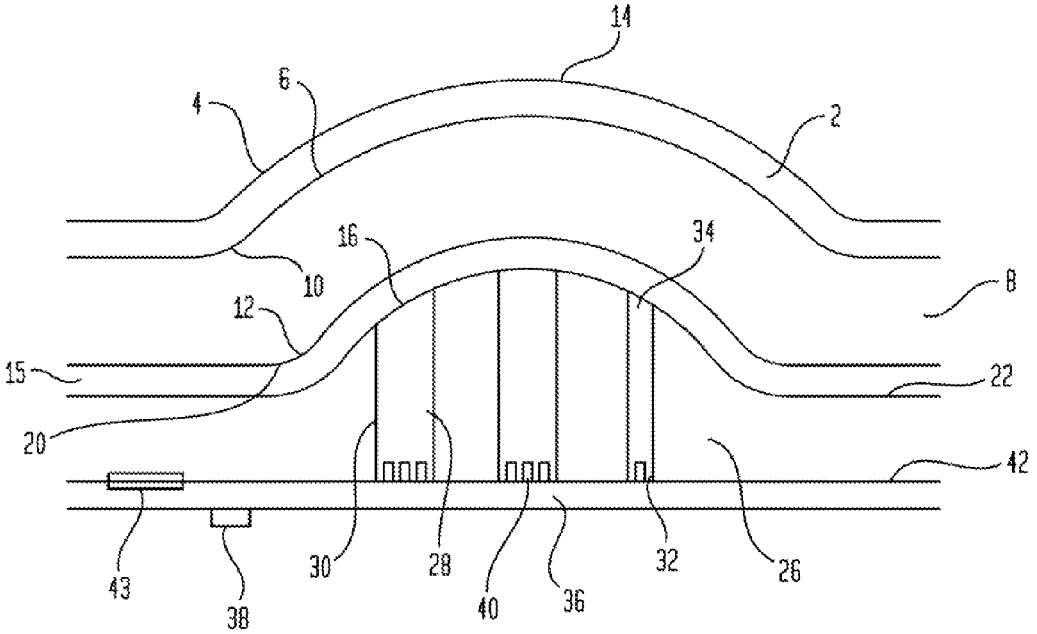
FIG. 2 is a schematic cross-sectional view of a display assembly as described herein.

FIG. 2 illustrates in cross-section one type of relationship of components in the display assembly. Curvature exists in the first plastic layer, the transparent structural plastic layer, the mask layer and the baffle layer. The printed circuit board preferably is flat rather than having curvature.

Curvature results in different distances between an LED and the mask layer. Sharply imaged uniformly bright graphics therefore require light balancing to compensate for the different distances. For instance, words or portions of words near the center of curvature will require a greater amount of light energy output than those nearer areas peripheral to a central rounded area of the curvature. Balancing can be accomplished by adjusting brightness of each individual LED proportional to the respective travel distance between the light source and mask layer. Brightness is modulated by the electrical energy input to an LED. Data storage elements 43 held on the printed circuit board can control electrical energy levels delivered to the LEDs.

The structural plastic layer 8 may typically have a cross-sectional thickness ranging from 0.3 to 20 mm, more typically from 0.3 to 10 mm and sometimes from 0.5 to 3 mm. The first plastic layer 2 ordinarily may have a smaller cross-sectional thickness than that of the structural plastic layer. For instance, the thickness may range from 1 to 50, alternatively from 3 to 20, and possibly from 3 to 10 mil (1 mil=0.0254 mm).

The first plastic layer may be formed of a thermoplastic material such as a polycarbonate. Often this layer is tinted to provide the desired color of the display surface such as a non-black viewer perceived tint. The first plastic layer imparts a glossy finish and luxurious appearance to the display assembly.

A suitable process of manufacturing the display assembly is initially to form the first plastic layer as a skin in a mold. This technology is similar to in-mold label formation. Once this skin of first plastic layer is formed, the mold through an injection molding process receives resin forming the structural plastic layer. The resultant combination then receives the mask layer. Thereafter, the combination is combined with the baffle layer and printed circuit board.

Figure 3:
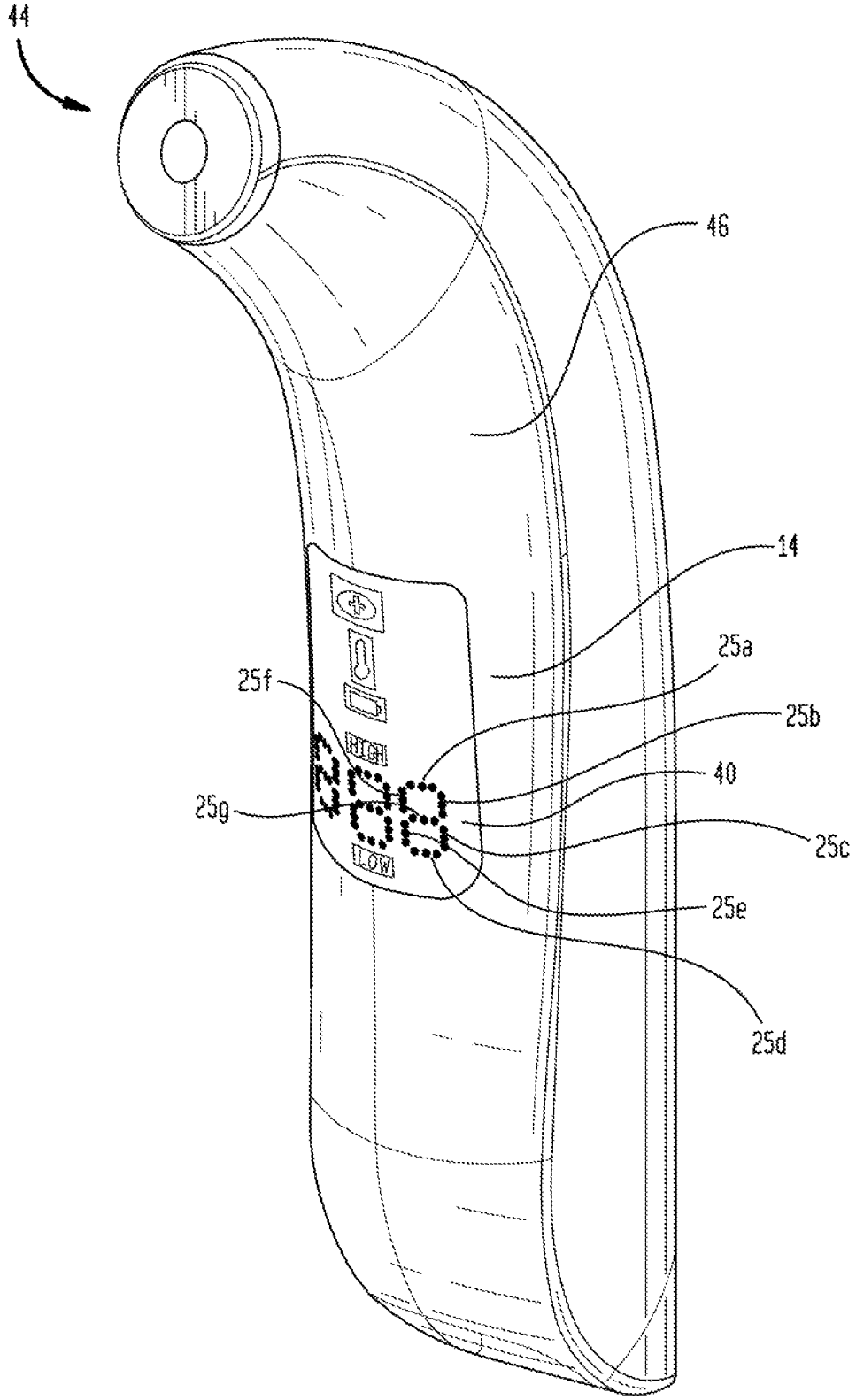
FIG. 3 illustrates a typical appliance that can utilize he dead front display assembly described herein.

FIG. 3 depicts an appliance device which is a hand-holdable laser 44 that can utilize the dead front display assembly. Housing walls 46 are curved in an area of the display assembly that needs to be viewable. Formation of a numeral through pixels is illustrated on the laser appliance device The numeral "8" is formed with seven separate banks of LEDs. Each bank has a set of three pixels. These banks are represented by 25*a*, 25*b*, 25*c*, 25*d*, 25*e*, 25*f* and 25*g*.

The above description is presented to enable a person skilled in the art to make and use the invention, and is provided in the context of a particular application and its requirements. Various modifications to the preferred embodiments will be readily apparent to those skilled in the art, and the generic principles defined herein may be applied to other embodiments and applications without departing from the spirit and scope of the invention. Thus, this invention is not intended to be limited to the embodiments shown, but is to be accorded the widest scope consistent with the principles and features disclosed herein.

What is claimed is:

1. A curved dead front display assembly comprising:

a first plastic layer having outer and inner surfaces;

a transparent structural plastic layer having a first and second surface, the first surface contacting the inner surface of the first plastic layer;

a mask layer with an array of light transparent windows defining at least one graphic and having a front and a rear side, the front side contacting the second surface of the structural plastic layer;

a baffle layer having a plurality of hollow chambers allowing light transmission from an open end to an exit end, the chambers being separated from one another by light opaque walls, the exit end contacting the rear side of the mask layer; and a printed circuit board having electrical signal connections and an upper surface comprising a plurality of light emitting diodes, each of the light emitting diodes being aligned with one of the plurality of chambers, the upper surface contacting the open end of the baffle layer.

2. The display assembly according to claim 1 wherein the graphic is selected from the group consisting of a symbol, a numeral, an alphabet letter, a word and combinations thereof.

3. The display assembly according to claim 1 wherein the light transmission is balanced by delivering different electrical energy levels to different light emitting diodes to achieve uniformly bright graphics.

4. The display assembly according to claim 1 wherein the printed circuit board further comprises data storage elements controlling electrical energy levels delivered to the light emitting diodes.

5. The display assembly according to claim 1 wherein the first plastic layer has a smaller cross-sectional thickness than that of the structural plastic layer.

6. The display assembly according to claim 1 wherein the transparent plastic is formed of polycarbonate.

7. The display assembly according to claim 1 wherein the first plastic layer is opaque when viewed by a human observer.

8. The display assembly according to claim 1 wherein the structural plastic layer has a cross-sectional thickness ranging from 0.3 to 20 mm.

9. The display assembly according to claim 7 wherein the first plastic layer has a cross-sectional thickness ranging from 3 to 10 mil.

* * * * *